United States Patent [19]

Rutten et al.

[11] Patent Number: 4,481,900

[45] Date of Patent: Nov. 13, 1984

[54] SEA ANCHOR

[75] Inventors: Peter T. Rutten, Plainfield, Ill.; James E. Kalinowski, Minneapolis, Minn.

[73] Assignee: Blue Harbor, Inc., Hopkins, Minn.

[21] Appl. No.: 361,829

[22] Filed: Mar. 25, 1982

[51] Int. Cl.[3] ..... B63B 21/48

[52] U.S. Cl. ..... 114/311

[58] Field of Search ..... 114/311; 244/142

[56] References Cited

U.S. PATENT DOCUMENTS

| | | | |
|---|---|---|---|
| 1,308,375 | 7/1919 | Satre | 244/142 |
| 1,575,134 | 3/1926 | Stocking | 114/311 |
| 3,459,151 | 8/1969 | Chiba | 114/311 |

FOREIGN PATENT DOCUMENTS

| | | | |
|---|---|---|---|
| 13553 | of 1904 | United Kingdom | 114/311 |

*Primary Examiner*—Trygve M. Blix
*Assistant Examiner*—Ivy M. Shum
*Attorney, Agent, or Firm*—Trexler, Bushnell & Wolters, Ltd.

[57] ABSTRACT

A sea anchor is disclosed which comprises a generally cylindrical body of cloth or the like material open at the forward end. The opposite end is provided with a hem through which a rope or the like is passed to draw the opposite end more or less closed. Tow members are secured to the periphery of the sea anchor at the open end of the body, and a single control line is connected adjacent the opposite end of the body. Pulling on the control line independently of the tow members partially inverts or turns inside out the body of the sea anchor, thus reducing the maximum depth thereof, and greatly reducing the drag, thus to limit the anchoring effect, and to facilitate return of the sea anchor to a boat or the like.

5 Claims, 8 Drawing Figures

FIG. 1
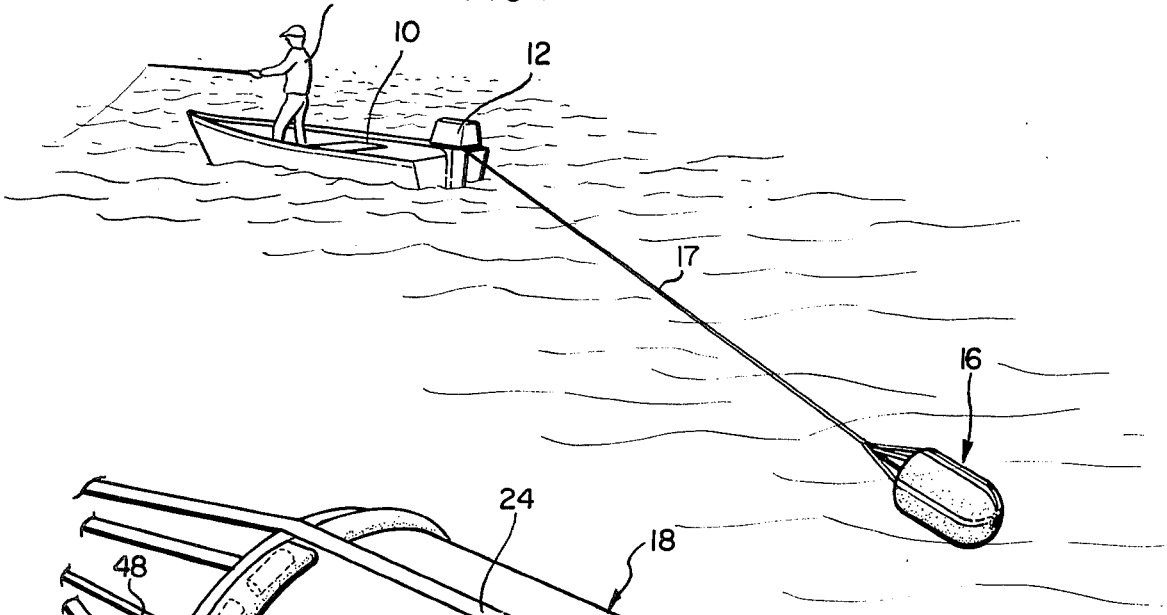
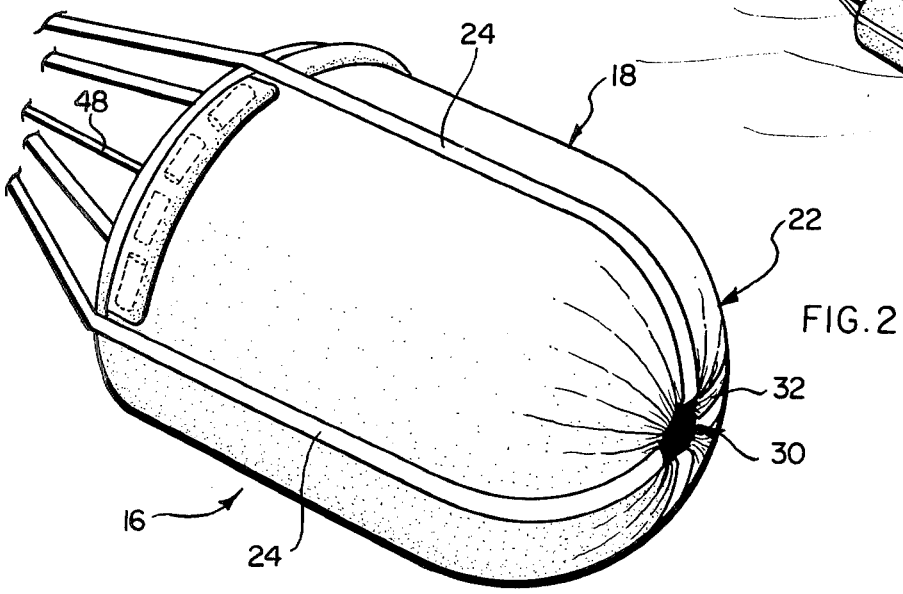
FIG. 2
FIG. 3
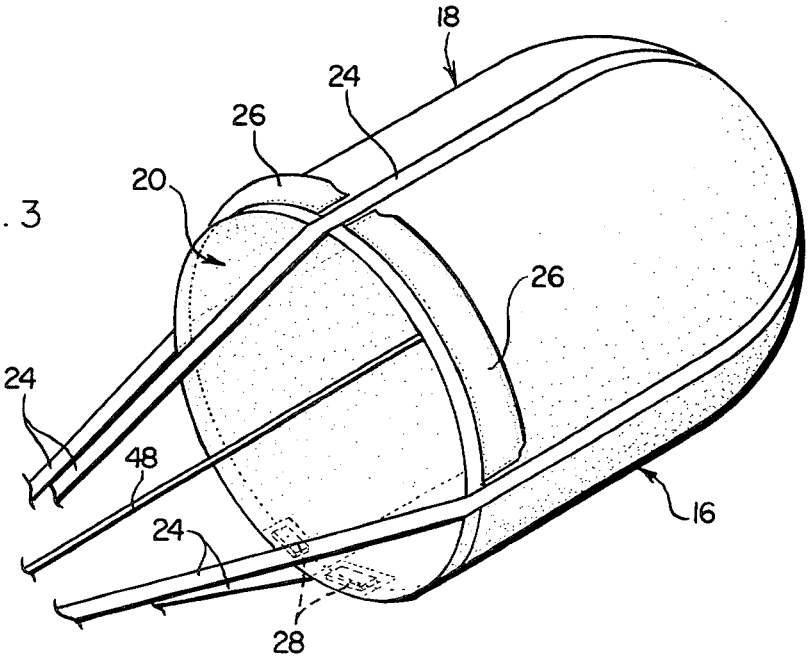

FIG. 4
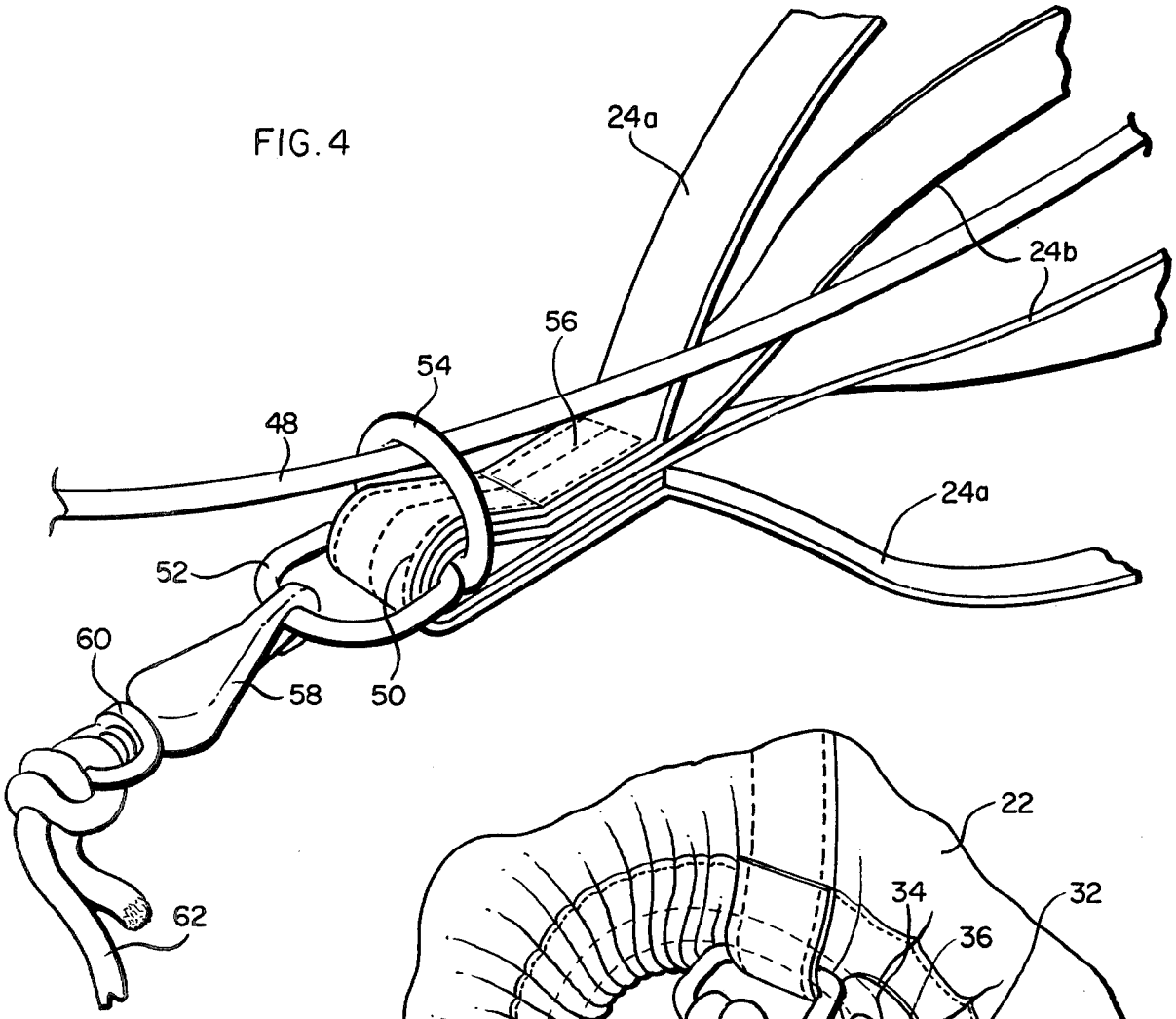
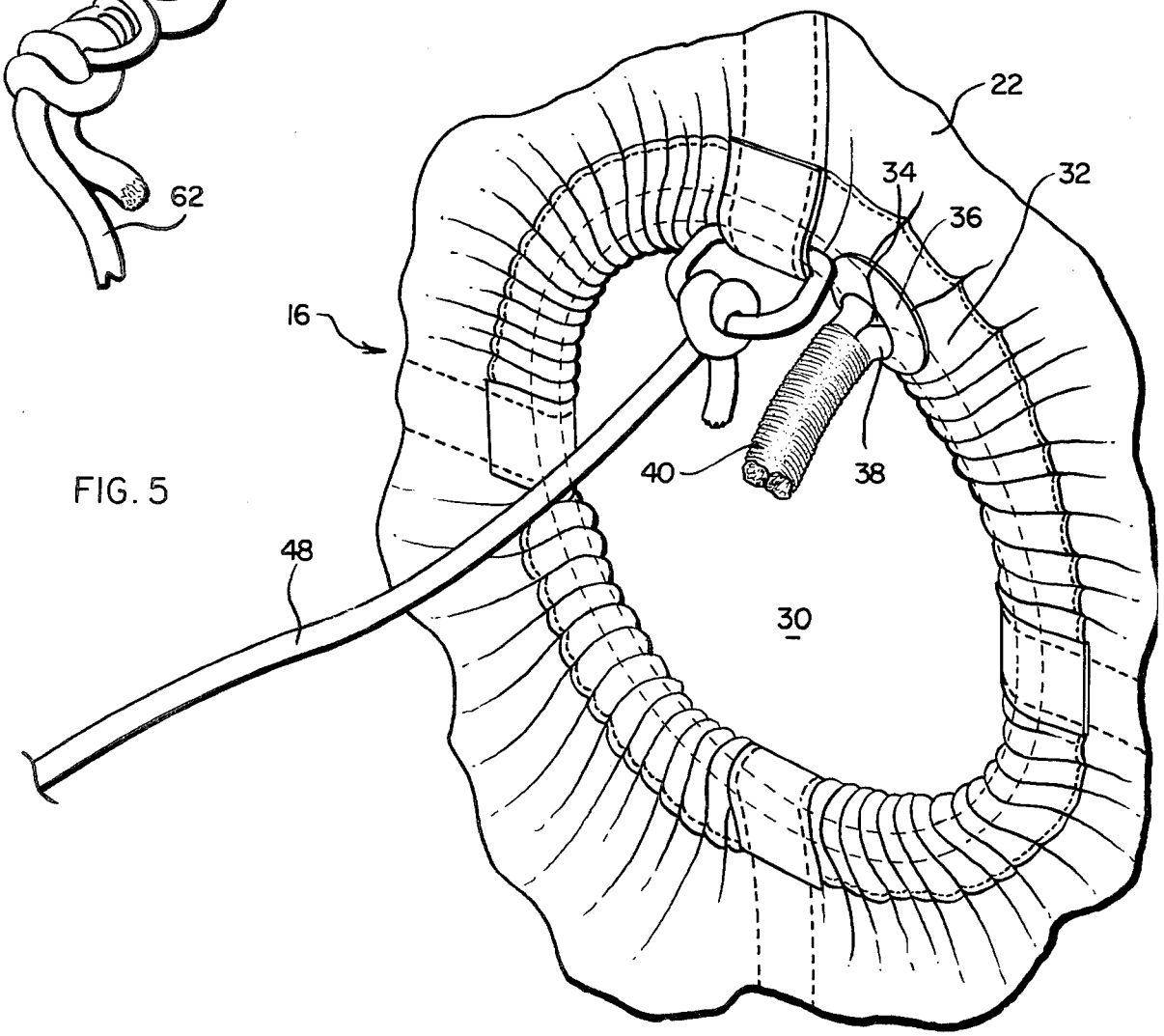
FIG. 5

SEA ANCHOR

BACKGROUND OF THE INVENTION

Sea anchors are known in the nautical arts and are used for many purposes. Sea anchors are somewhat in the form of a parachute, and are deployed beneath the surface of the water and resist moving through the water. A sea anchor may be used to more or less anchor a boat against the movement of the wind and surface currents when it is desired to fish from the boat, for example. A sea anchor may also be very useful with a boat that is used for trolling. In larger boats, both inboard and outboard, and also the inboard-outboard variety, it is often not possible to slow the engine down to a proper point for achieving the necessary low speed for trolling. A sea anchor may be used to slow the speed.

Prior sea anchors are generally fixed in the extent to which they can provide resistance to movement through the water. Thus, while a given sea anchor may be quite satisfactory for obtaining trolling speed with one boat, it may be entirely unsatisfactory for a different boat. Furthermore, conventional sea anchors are difficult to return to the boat, except for certain sea anchors that may be inverted for retrieval. However, such latter anchors cannot then be redeployed without being taken on board the boat, thus precluding the possibility of repositioning the sea anchor relative to the boat without entirely removing the sea anchor from the water.

OBJECTS AND SUMMARY OF THE PRESENT INVENTION

It is an object of the present invention to provide a sea anchor that can be adjusted while in the water to provide varying amounts of resistance to movement through the water.

It is another object of the present invention to provide a sea anchor which can be reduced substantially in drag for return to a boat, but which can be redeployed to full drag without the necessity of pulling the sea anchor aboard the boat.

In attaining the foregoing and other objects and advantages we have provided a sea anchor with a central opening. The opening is adjustable as to size before the sea anchor is placed in the water, thus to determine the maximum drag attainable, in accordance with the necessity of a given boat. Furthermore, the sea anchor is provided with pull-type controls from the boat for turning the sea anchor partially inside out, and thus markedly to vary the amount of drag to be obtained, less than the maximum drag. Turning of the anchor substantially inside out markedly reduces the drag so that the anchor can be pulled toward the boat without great effort. However, since the sea anchor is never turned completely inside out, it can be substantially instantly redeployed from the boat without the necessity of hoisting it aboard the boat.

THE DRAWINGS

The present invention will best be understood with reference to the accompanying drawings when taken in connection with the accompanying specification. In the drawings:

FIG. 1 comprises a perspective view showing the sea anchor of the present invention and is utilized to maintain an outboard motor boat at trolling speed;

FIG. 2 is a perspective view on a somewhat enlarged scale showing the sea anchor of the present invention generally from the back;

FIG. 3 is a perspective view of the sea anchor as taken generally from the front;

FIG. 4 is a perspective view on an enlarged scale showing the connecting straps of the sea anchor as attached to a tow rope from the boat, and also showing the control line acting between the boat and the sea anchor;

FIG. 5 is a perspective view on an enlarged scale of a portion of the sea anchor showing the attachment of the control rope thereto;

DETAILED DESCRIPTION OF THE DISCLOSED EMBODIMENT

Figure 6:
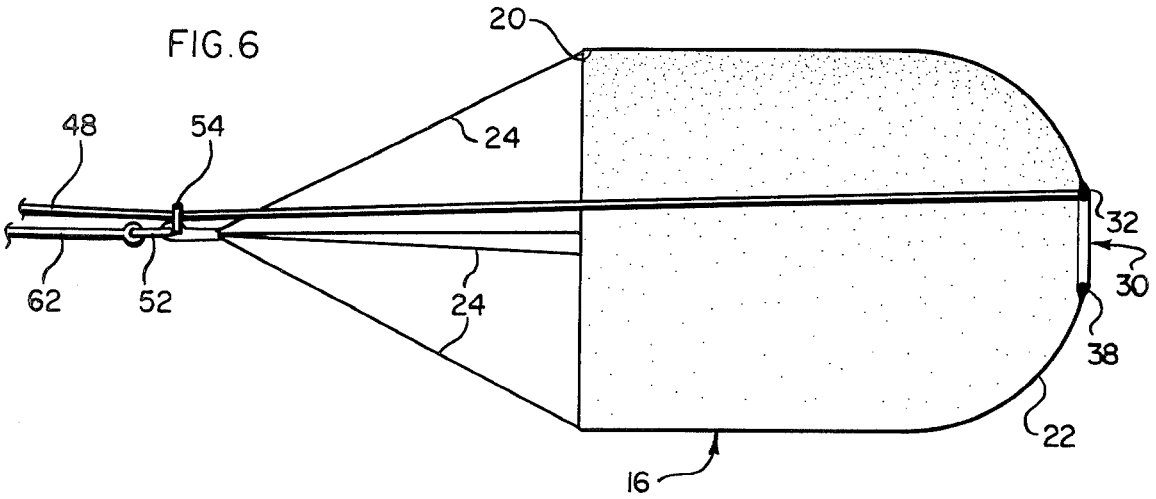
FIG. 6 is a side view showing the sea anchor in its normally deployed condition.

Referring first to FIG. 1 there will be seen a small boat 10 driven by an outboard motor 12 with a fisherman 14 in the boat. A sea anchor 16 constructed in accordance with the present invention is secured to the boat by a suitable cable or rope structure 62. As is shown, the power on the boat has been shut off, and the sea anchor 16 determines the position of the boat by applying a drag thereto, acting against winds or surface currents so that the fisherman may maintain the boat where he wants it. Alternatively, with power on the sea anchor will slow the boat to a proper speed for trolling.

The sea anchor 16 is shown in greater detail in FIGS. 2 and 3, and comprises a generally cylindrical body portion 18 open at the front end as indicated at 20, and having a dome-shaped trailing end 22 which is nearly closed. The sea anchor is made of fabric, preferably a synthetic such as nylon or polyester, and comprises conveniently one or a plurality of panels sewn together, along with tapes or straps 24 (illustrated as four in number) stitched to the cloth such as along the seams and connected to a tow rope as will be described hereinafter, and forming a part of the cable or rope structure 62. Adjacent its open end 20, the sea anchor is provided with openable pockets 26 containing sections of foam or lead 28 for determining the depth at which the sea anchor will operate.

The dome-shaped trailing end 22 is not quite closed, having an aperture 30 therein, see also FIG. 5. The opening 30 is defined by a hem 32 stitched in the fabric of the sea anchor, and having an opening 34 encircled by a reinforcing grommet 36. A rope 38 extends through the hem 32 and has the ends thereof extending out through the grommet 36 and suitably lashed at 40. The rope can be drawn up to a greater or lesser extent before lashing, thus to determine the size of the opening 30. As will be understood, the size of the opening 30 has a very considerable effect on the maximum drag to be exerted by the sea anchor. Such adjustment of the diameter of the aperture 30 is normally made before the sea anchor is immersed in the water, and the diameter will depend on the power of the boat which is to be slowed for trolling, the necessary speed, and other factors.

A ring 42 is secured by the tucked-over and stitched end of one of the tapes 24 as shown at 44 and has secured thereto a suitable knot 44 at the end of a control rope 48 forming a part of the cable 18. Alternatively the rope 48 may be tied to the rope 38 (or secured thereto by a ring) to effect restriction of the opening 30 by pulling on the control rope 48 and subsequent return to the preset maximum size upon reducing tension on the control rope.

Reference now should be made to FIG. 4 wherein the front ends of the straps 24 are shown. Two of the straps, identified as 24*a*, are a continuous tape or strap looped over at 50 and securing two rings 52 and 54. The surfaces of the two straps or strap portions 24*a* are straight and untwisted and form a flat section 56 adjacent the loop 50. The other two straps, here identified as 24*b*, must be twisted 90° to fit between the straps 24*a* in the flat section 56 and in the loop 50, the entire being stitched together. One of the straps 24*b* is twisted in one direction, and the other in the opposite direction to prevent spiraling of the sea anchor as it is pulled through the water. It has been found that the flat straps are far superior to ropes in avoiding tangling. The ring 52 has a spring clip 58 secured thereto, and provided with a swivel 60 attached to a rope 62 forming a part of the cable or rope assembly 17. Alternatively, the rope may be tied directly to the ring 52. The ring 54 serves as a guide for the rope 48, and as a limit stop for the hem 32 about the aperture 30 as will be set forth shortly hereinafter. In one practical construction of the present invention the rope 48 is of a distinctive coloring for guidance of the boatman, as also will be brought out shortly hereinafter.

Figure 7:
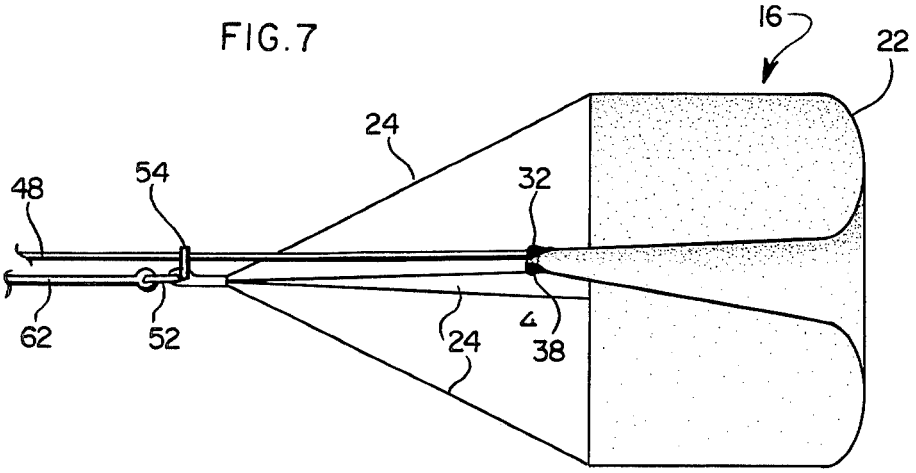
FIG. 7 is a view similar to FIG. 6 showing the start of an anchor-collapsing operation.
Figure 8:
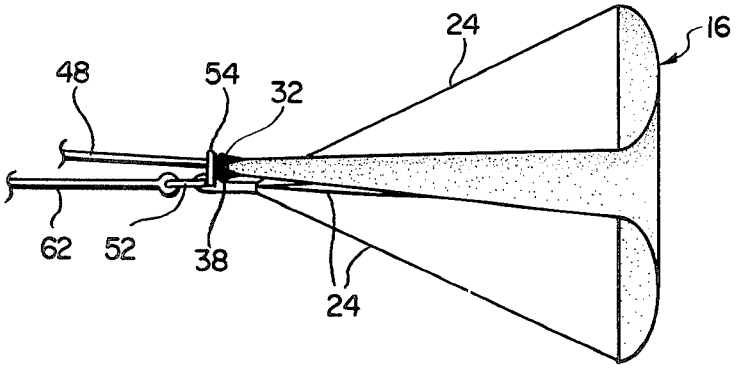
FIG. 8 is a view generally similar to FIGS. 6 and 7, but showing the sea anchor in an almost collapsed or inside out condition.

Reference should now be made to the somewhat schematic diagrams of FIGS. 6–8 for an understanding of operation of the sea anchor of the present invention. As shown in FIG. 6 the sea anchor is fully deployed, and presents a maximum drag on the boat to which it is attached, commensurate with the predetermined size of the opening 30. It will be realized that the rope 48 can be pulled independently of the rope 62, whereby the rear end of the sea anchor can be pulled into the interior thereof. While we have disclosed the best mode of our invention, we contemplate less expensive forms thereof in which the weights and floats may be omitted, and in which the straps may simply be attached to the hem without extending to the back of the sea anchor. We also contemplate omission of the control rope with the degree of drag produced by the sea anchor to be predetermined by the user by adjustment of the size of the aperture 30. As the sea anchor is progressively inverted, as in the position shown in FIG. 7, the drag becomes progressively less due to the decrease in depth (or axial length) of the sea anchor. As pull is continued on the rope 48 the sea anchor will be almost completely turned inside out as shown in FIG. 8. Beyond a certain point of turning the sea anchor inside out the material pulls so that the outer diameter of the anchor is substantially reduced, thus enhancing the reduction in drag effected by shortening the length of the body of the sea anchor.

The ring 54 is of small enough diameter that, although the rope 48 moves freely therethrough, the rope 38, the grommet 36, the hem 32, etc., will not pass through the ring 54. Thus, the degree to which the sea anchor can be turned inside out is limited, essentially as shown in solid lines in FIG. 8. Thus, the sea anchor can never be completely turned inside out. With the reduction in depth and outside diameter the drag becomes progressively less, as noted, whereby the anchoring effect thereof is decreased, and whereby the sea anchor can readily be pulled toward or into the boat as desired. However, since the anchor is never completely inside out, if the rope 48 is released to a desired degree relative to the rope 62 the sea anchor will revert to its original configuration, thereby again exerting maximum drag. As will be appreciated, it is not necessary to pull the anchor onto the boat to effect this return toward its greatest effectiveness.

The sea anchor may be used to position a boat for fishing from the boat with the sea anchor resisting drifting of the boat due to wind and surface currents. It also can be used to reduce the speed of trolling, and this has an advantage over simply slowing the engines, as reduced thrust of the engine or engines tends to inhibit directional stability; here, with a significant degree of thrust still exerted and the sea anchor acting as a restraint, there is excellent directional stability. The sea anchor can be made in different diameters and different depths to achieve different degrees of braking capacity. The aperture 30 can vary anywhere from the same diameter as the front of the sea anchor to essentially no opening whatsoever, simply by adjustment of the rope 38 in the hem 32. Providing a distinctive color to the control rope 48 makes it readily apparent what rope should be pulled on for adjustment of the sea anchor while in use.

The sea anchor as disclosed herein is relatively inexpensive to produce, and it is of great effect, and readily adjustable by the user.

The specific example of the invention as herein shown and described is for illustrative purposes. Various changes in structure will no doubt occur to those skilled in the art, and will be understood as forming a part of the present invention insofar as they fall within the spirit and scope of the appended claims.

The invention is claimed as follows:

1. A sea anchor made of cloth or the like comprising a body open at one end and at least partially closed at the other end, said body including a tubular portion open at the front end and having a substantially hemispherical portion at the rear end tapering to a substantially closed apex, a plurality of elongated tow members secured to the periphery of the open end in arcuate spaced relation, an elongated tow rope to which said tow members are connected for securement to a boat for sea-anchoring said boat, and additional means comprising a line secured to said body substantially hemispherical portion apex and remotely operable from said boat for at least partly turning said body inside out, and guide means secured adjacent the connection of said tow members and said tow rope and through which said line extends.

2. A sea anchor as set forth in claim 1 wherein said guide means comprises a ring interconnected with said tow members and through which said line passes.

3. A sea anchor as set forth in claim 1 wherein said tow members comprise pairs of flat straps secured to said body as reinforcements and converging to a junction forwardly of the open end of said sea anchor body, at least one of said pairs being straight and secured in face-to-face engagement at said junction, and at least one other pair of straps being reversely twisted relative to one another and secured at said junction in face-to-face engagement with said first mentioned at least one pair.

4. A sea anchor as set forth in claim 1 and further including means connected to said line and engageable with said guide means for limiting the degree to which said body is turned inside out to a condition short of completely turned inside out.

5. A sea anchor as set forth in claim 4 wherein the guide means comprises a ring on said tow members through which said line passes.

* * * * *